United States Patent [19]

Landers

[11] Patent Number: 4,905,441

[45] Date of Patent: Mar. 6, 1990

[54] SYSTEM FOR STRENGTHENING STRUCTURAL ELEMENTS

[75] Inventor: Phillip G. Landers, San Ramon, Calif.

[73] Assignee: Insitu Corporation, Dublin, Calif.

[21] Appl. No.: 282,750

[22] Filed: Dec. 12, 1988

[51] Int. Cl.[4] ..... E02D 27/00

[52] U.S. Cl. ..... 52/514; 52/232; 52/309.4; 264/36; 156/94; 428/317.9

[58] Field of Search ..... 52/514, 232, 309.4; 264/36; 156/94; 428/318.4, 317.9

[56] References Cited

U.S. PATENT DOCUMENTS

| | | | |
|---|---|---|---|
| 3,362,124 | 1/1968 | Cravens et al. | 52/514 |
| 3,816,610 | 6/1974 | Lusby | 52/309.4 X |
| 3,844,863 | 10/1974 | Forsythe et al. | 264/36 X |
| 4,364,987 | 12/1982 | Goodwin | 428/317.9 X |
| 4,869,478 | 3/1989 | Bernard | 52/309.4 |

*Primary Examiner*—Carl D. Friedman

*Attorney, Agent, or Firm*—Thomas R. Lampe

[57] ABSTRACT

A system for strengthening a structural element, such as a wooden utility pole, wherein a structural foaming agent fills a void space defined by the structural element and a structural foaming agent within a container is employed to plug a passageway leading from the exterior of the structural element to the void space.

17 Claims, 2 Drawing Sheets

SYSTEM FOR STRENGTHENING STRUCTURAL ELEMENTS

TECHNICAL FIELD

This invention relates to a system for strengthening structural elements.

The system disclosed herein has particular application to structural elements in the form of wood poles, and the system can be effectively utilized to strengthen and repair wood poles damaged by woodpeckers.

BACKGROUND ART

Woodpeckers damage or destroy millions of wood poles annually by boring and nesting, obviously resulting in great economic loss.

Attempts have been made to effect repair of wood poles damaged by woodpeckers. Prior art repair techniques include, for example, filling the void space in the pole with various materials including thermo-setting resins, rocks, or concrete, and/or covering the hole with metal-screen material.

These prior art techniques have not been satisfactory. Not only are they expensive and time consuming, they do not deal with certain basic problems which must be addressed when repairing woodpecker holes.

It is quite common for the wood in the interior of a pole surrounding a woodpecker hole to consist of soft, or punky, wood, a result of decay caused by damage to the pole within its interior. For pole repair to be truly effective, an adequate degree of bond must exist between the repair material and the deteriorating wood to provide a structural transfer of load from the wood pole to the repair material. Prior art repair techniques do not resolve this problem in an effective manner.

When wooden utility poles must be climbed to effect repair or maintenance, it is quite common for the person doing the climbing to use conventional climbing spikes or gaffs. The repaired wood-pole section must be sufficiently soft to allow the penetration of these gaffs yet strong enough to withstand the weight of the person using them. It will be appreciated that the prior art wood pole repair materials identified above do not lend themselves to use with a climbing gaff.

DISCLOSURE OF THE INVENTION

The present invention, by contrast, relates to a system which may be utilized to strengthen a structural element, such as a woodpecker-damaged wood pole, which successfully addresses the two problems noted above. In particular, the present system provides a high degree of bonding between repair material and the deteriorating wood so that there is a structural transfer of load from the wood pole to the repair material. Additionally, the present system utilizes a repair material allowing penetration of gaffs yet is strong enough to withstand the weight of the person using such equipment. In addition, through utilization of the system of the present invention, strengthening and repair of structural elements can be quickly effected.

According to the teachings of the present invention, a structural element defining a void space and having a passageway leading from the exterior of the structural element to the void space is strengthened by first inserting a structural foaming agent into the void space in an essentially unfoamed state so that the essentially unfoamed structural foaming agent partially fills the void space.

After insertion of the foaming agent into the void space, a flexible container having structural foaming agent in an essentially unfoamed state is positioned in the passageway. The passageway is then sealed by foaming the structural foaming agent within the container and bonding the container to the portion to the structural element defining the passageway.

After the step of sealing the passageway, the void space defined by the structural element is substantially filled by foaming the structural foaming agent within the void space. The foamed structural foaming agent in both the void space and in the container are hardened to form a secure, rigid bond between the structural element, the foamed structural foaming agent, and the container.

Another feature of the present invention involves the utilization of discrete fibers in the structural foaming agent. When carrying out the method of the present invention, the structural foaming agent and fibers cooperate to add both tensile and flexural strength to the repaired portion of the structural element. Such fibers are also utilized to provide a high-shear strength surface at the location of the passageway which will readily support a gaff. While addition of high-strength fibers such as fiberglass fibers to resins is known in the prior art, the system of the present invention utilizes such fibers in a novel manner to obtain certain specific desired results.

Other features, advantages, and objects of the present invention will become apparent with reference to the following detailed description and accompanying drawings.

BEST MODE FOR CARRYING OUT THE INVENTION

Figure 1:
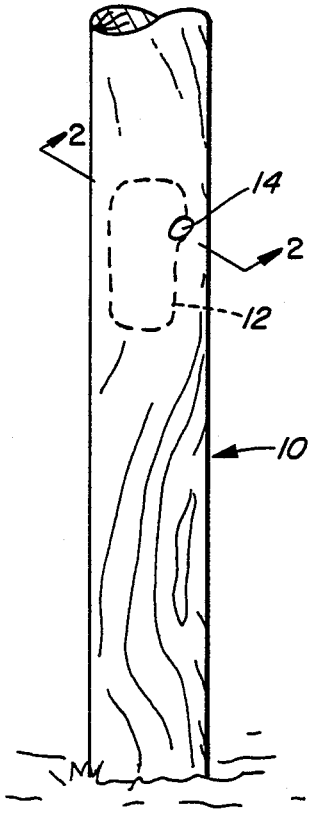
FIG. 1 is a perspective view of a wooden pole with a woodpecker hole, said hole including a void space in the pole and a passageway leading thereto.
Figure 2:
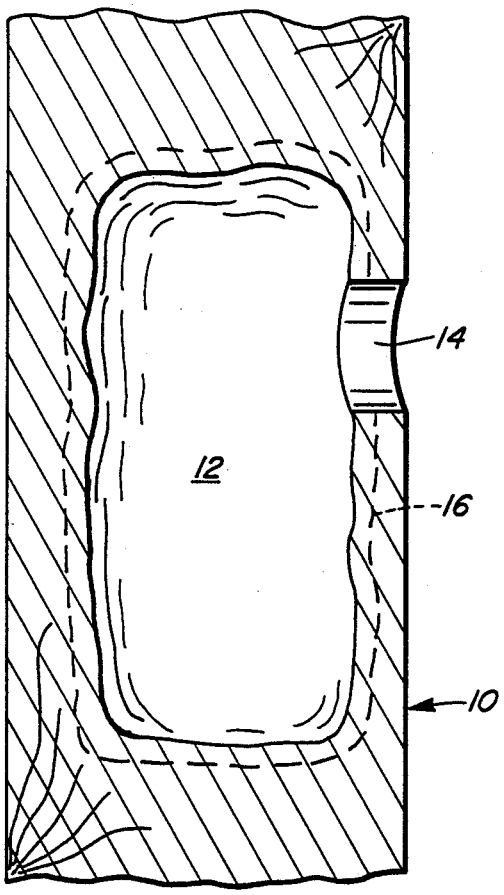
FIG. 2 is an enlarged, cross-sectional view taken along the line 2—2 of FIG. 1.

Referring now to FIGS. 1 and 2, a section of a structural element in the form of a conventional wooden utility pole 10 is shown. The pole 10 defines a void space 12 therein. Void space 12 has a configuration typical of that formed by woodpeckers within utility poles and other wooden structures. A passageway 14, also caused by a woodpecker, leads from the exterior of pole 10 to the void space. As can clearly be seen, passageway 14 is much smaller than the actual void space. This is typical of the damage done by woodpeckers when creating nest holes in wooden utility poles and other similar structures. The structural strength of such structure has actually been weakened far more by the woodpecker than one would be led to believe from simply observing the passageway 14. If not repaired, such damage can cause structural failure. This is particularly true since, as illustrated in FIG. 2, deterioration of the wood about the void space begins almost immediately after the woodpecker has formed the void space. Typically, the void space is surrounded by punky or deteriorated wood. In FIG. 2 such a deteriorated or punky portion is delineated by a dash line and designated by reference numeral 16.

Figure 3:
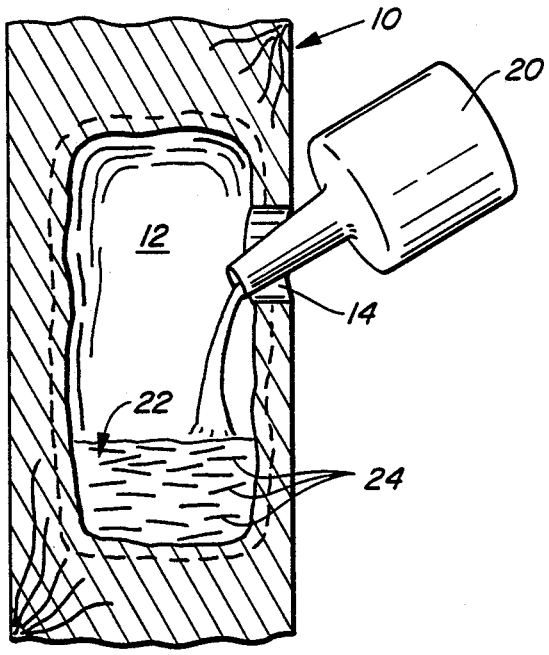
FIG. 3 is a cross-sectional view illustrating unfoamed structural foaming agent being positioned in the void space.

According to the system of the present invention, repair of pole 10 is effected by first inserting structural foaming agent into void space 12 so that the structural foaming agent partially fills the void space while the structural foaming agent is in an essentially unfoamed state. This step is illustrated in FIG. 3 wherein a bottle 20 containing the structural foaming agent has the outlet thereof inserted into passageway 14. The structural foaming agent 22 falls under the influence of gravity to the bottom of void space 12, as illustrated. Of course, any other suitable means for inserting the foaming agent into the void space may be utilized. For example, the injection means may be a foam injector of the type disclosed in U.S. patent application Ser. No. 020,665, filed Mar. 2, 1987 by Phillip G. Landers, now U.S. Pat. No. 4,751,947.

The structural foaming agent may be of any suitable type including that disclosed in U.S. Pat. No. 4,092,296 and also in U.S. Pat. No. 4,773,792. It will be appreciated that the structural foaming agent of the type employed in the present invention is of a multi-component nature, said components being mixed to initiate the chemical processes involved in the foaming action just prior to use. A foaming agent of the type disclosed in U.S. Pat. Nos. 4,092,296 and 4,773,792 are currently marketed by Insitu Corporation, Dublin, Calif., under the trademark "IFoam."

The amount of structural foaming agent inserted into void space 12 should be such that when the agent is fully foamed it will fill a volume somewhat in excess of the volume of void space 12. Further, the nature of the structural foaming agent should be such that it has a relatively slow foaming characteristic. The foaming speed of the foaming agents referenced above may, for example, be varied by varying the amount of catalyst or by varying the amount of blocking copolymer incorporated in the formulations.

One final point to be noted is that the structural foaming agent 22 has disposed therein a plurality of discrete elongated fibers 24 which may be formed of fiberglass or any other suitable relatively high-strength fiber. As shown in FIG. 3, fibers 24 are randomly disposed within the liquid structural foaming agent 22 when initially positioned in void space 12.

Figure 4:
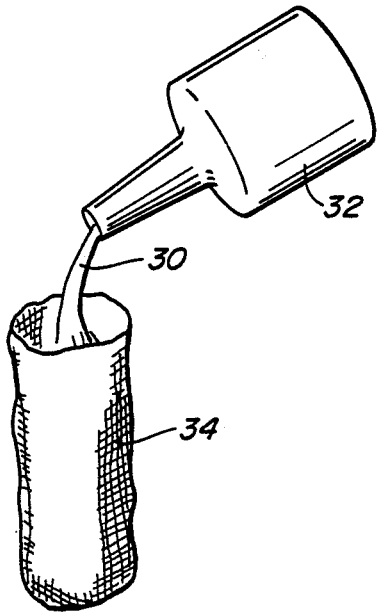
FIG. 4 illustrates unfoamed structural foaming agent filling a flexible container in the form of a bag to be subsequently utilized to plug the passageway in the pole leading to the void space.

The next step in the method of the present invention is illustrated in FIG. 4 wherein a structural foaming agent 30 is being poured from a bottle 32 into a bag 34. Structural foaming agent 30 may be of the same general type as structural foaming agent 22 which was inserted into void space 12, the only difference being that the formulation of structural foaming agent 30 is such that it is relatively fast foaming and fast setting. For example, structural foaming agent 30 may include a lesser amount of blocking copolymer.

Figure 5:
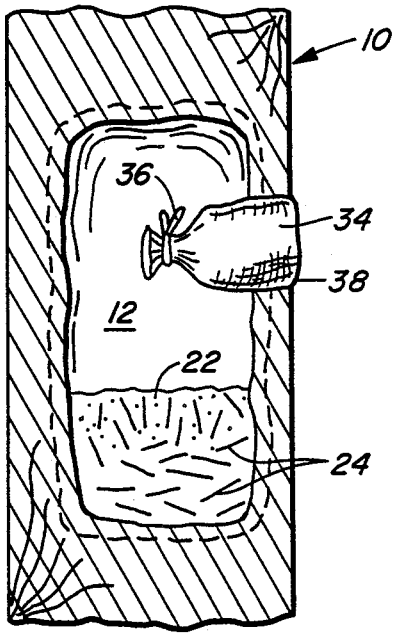
FIGS. 5 and 6 are schematic presentations in partial cross-section showing sequential steps of the present invention being carried out.

The bag 34 is virtually completely filled with the structural foaming agent 30 and then tied off to form a closed container as by means of a tie 36 (FIG. 5).

U.S. Pat. No. 4,773,792 discloses a bag material which is suitable for practicing the present invention. More particularly, the bag 34 is constructed of a flexible material, such as nylon, water-proof canvas, or the like, which is water repellant and woven so that it is somewhat porous. As with structural foaming agent 22, structural foaming agent 30 also contains a plurality of discrete, elongated fibers 42 of fiberglass or other suitable material randomly disposed therein. The fibers in structural foaming agent 30 are randomly disposed in structural foaming agent 30 when such agent is in the essentially unfoamed state it has when inserted into bag 34.

After bag or container 34 is filled and closed by tie 36, the bag is inserted into passageway 14 in the manner illustrated in FIG. 5. Preferably, the outer end of bag 34 (which was the closed bottom of the bag when filled) is positioned so that it is essentially flush with the exterior surface of pole 10. The outermost end of bag 34 is designated by reference numeral 38.

Figure 7:
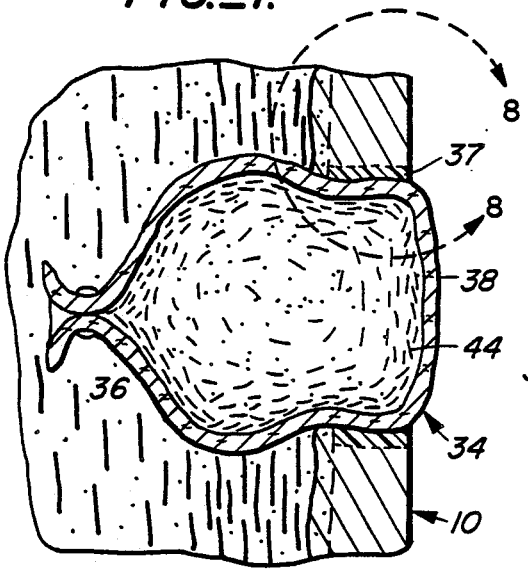
FIG. 7 is an enlarged, schematic cross-sectional view illustrating the void space and container filled with foamed structural foaming agent.
Figure 8:
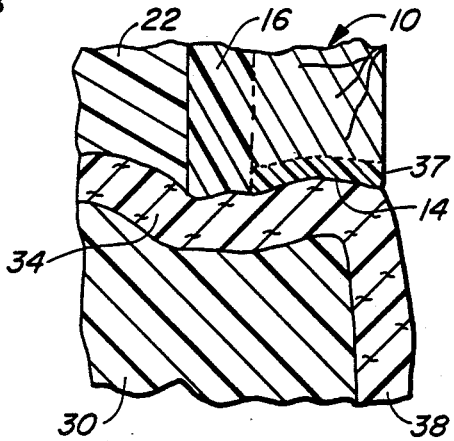
FIG. 8 is a greatly enlarged, schematic, cross-sectional view, illustrating that portion of FIG. 7 defined by the line 8—8.

Because the structural foaming agent formulation in bag 34 is relatively fast-rising and fast-setting, foaming takes place virtually immediately. As may be seen with reference to FIGS. 6, 7, and 8, the container 34 distorts as pressure builds up inside due to foaming of the agent. This distortion creates very tight contact between the outer surface of the bag and that portion of the pole defining passageway 14.

A second action also takes place that is equally important to the operation of the present system. As mentioned above, the material foaming the bag is relatively porous, being caused, for example, by loose weaving of the filaments comprising the material. Because of the internal pressure generated by the foaming agent, some of the structural foaming agent is forced through the porous material. Some of this extruded portion engages pole 10 about passageway 14 and actually impregnates the pole at such location. This impregnated portion is designated by reference numeral 37 in FIGS. 7 and 8. The degree of impregnation will depend somewhat, of course, upon the permeability of the fibers of the wood where impregnation takes place.

Another very important action takes place as some of the structural foaming agent 30 is passed out through the pores of bag 34. In particular, the foaming of the structural foaming agent within bag 34 and the migration of a portion thereof through the pores of the bag material cause movement of the discrete, elongated fibers 42. Some of the fibers will start migrating toward the porous material of the bag but such material will prevent the fibers from exiting the bag. In other words, the movement of fibers caused by foaming of the structural foaming agent in the container 34 will be interrupted by engaging the fibers and the porous material while structural foaming agent is forced through the porous material. This activity consolidates at least some of the fibers and forms a generally mat-like structure 44 (shown in FIG. 7 only) adjacent to the porous material. A portion of mat-like structure 44 is located at the bag outer end 38 and, when the foamed structural foaming agent hardens, the mat-like structure 44 will cooperate therewith to form a structure which will allow penetration of a gaff but have sufficient shear strength to withstand the weight of the person climbing with the gaff.

As stated above, structural foaming agent 22 in void space 12 is slow-rising as compared to the structural foaming agent 30 in container or bag 34. Structural foaming agent 30 will expand and harden before structural foaming agent 22 foams and expands completely within void space 12. This means that foamed structural foaming agent 22 cannot escape through passageway 14. Instead, the pressures generated by the foaming process force the structural foaming agent into the soft, punky, wood fibers designated by reference numeral 16. The foaming agent identified above provides exotherm temperatures in excess of 200 degrees fahrenheit at which point the confined foam boils and is forced under pressure into the punky wood 16.

Figure 6:
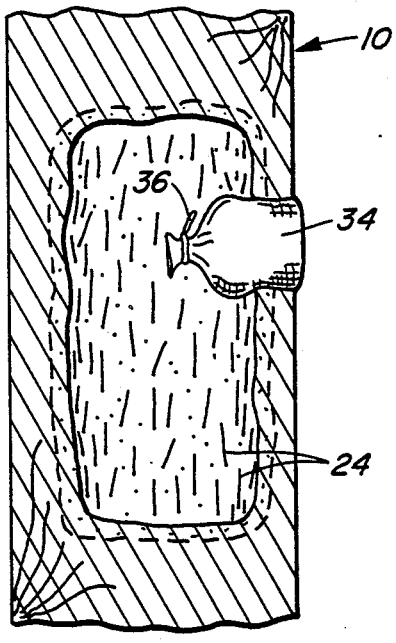

An important action takes place during foaming of structural foaming agent 22 with respect to the fibers 24 disposed therein. As may be seen with reference to FIG. 5, as the foaming structural foaming agent rises, fibers 24 are drawn into the direction of rise and thus the fibers are aligned in the direction of foam rise. In other words, when fibers 24 are moved during foaming of the structural foaming agents 22, a substantial number of the elongated fibers are oriented so that the major axes thereof are essentially uni-directionally disposed within void space 12 after foaming, as shown in FIG. 6. Also, as the foaming structural foaming agent impregnates punky wood 16, the punky wood acts as a filter to deposit some of the fibers 24 at the interface between the wood and the structural foaming agent.

This combination of structural foaming agent impregnated wood, fibers bonded to the interface between the wood and foam, and aligned fibers provides a high strength, structural repair of the woodpecker hole. When structural foaming agent 22 is completely foamed and hardened, such agent will substantially fill the void space. The container or bag 34 in the passageway defines an interior filled with hardened, foamed structural foaming agent while the exterior has hardened-foamed structural foaming agent bonded thereto and to the structural element to form a plug in the passageway.

I claim:

1. A method of strengthening a structural element defining a void space and having a passageway leading from the exterior of said structural element to said void space, said method comprising the steps of:

inserting structural foaming agent into said void space in an essentially unfoamed state so that said essentially unfoamed structural foaming agent partially fills said void space;

after said inserting step, positioning in said passageway a flexible container having structural foaming agent therein while said structural foaming agent in said flexible container is in an essentially unfoamed state;

after said positioning step, sealing said passageway by foaming the structural foaming agent within the flexible container to form a bond between said flexible container and said structural element at the location of said passageway; and substantially filling said void space after the step of sealing said passageway by foaming and expanding the structural foaming agent within said void space.

2. The method according to claim 1 wherein the structural foaming agent in said void space is foamed at a slower rate than the structural foaming agent is foamed in said flexible container.

3. The method according to claim 1 additionally comprising the step of hardening the foamed structural foaming agent in both said void space and in said container to form a secure, rigid bond between said structural element, said foamed structural foaming agent, and said container.

4. The method according to claim 1 including the step of impregnating at least some of said structural element with said structural foaming agent during foaming thereof.

5. The method according to claim 1 wherein the structural foaming agent in at least one of said void space and said container has discrete fibers therein, said method including the step of moving at least some of said fibers with said structural foaming agent during foaming of the structural foaming agent.

6. The method according to claim 5 wherein discrete, elongated fibers are in the structural foaming agent in said void space, the step of moving said fibers including orienting a substantial number of said elongated fibers so that the major axes of said oriented fibers are essentially uni-directionally disposed within said void space.

7. The method according to claim 5 wherein discrete fibers are in the structural foaming agent within said container, and wherein said container is at least partially comprised of porous material, the step of moving said fibers including consolidating at least some of said fibers to form a generally mat-like structure adjacent to said porous material.

8. The method according to claim 7 wherein some of the structural foaming agent in said container is forced under pressure through said porous material during foaming thereof, said consolidating step being carried out by interrupting movement of fibers caused by foaming of the structural foaming agent in said container by engaging said fibers and said porous material while structural foaming agent is forced through said porous material.

9. The method according to claim 1 wherein said structural element is a wooden pole with punky wood at least partially defining said void space, said method including the additional steps of impregnating said punky wood with structural foaming agent during foaming thereof in said void space and hardening said structural foaming agent in said void space and in said punky wood.

10. A method of strengthening a structural element defining a void space, said method comprising the steps of:

mixing a plurality of discrete, elongated fibers with structural foaming agent while said structural foaming agent is in an essentially unfoamed state;

after said mixing step, inserting said mixture of essentially unfoamed structural foaming agent and discrete, elongated fibers into said void space to partially fill said void space;

after said inserting step, foaming said structural foaming agent within said void space to expand said foaming agent;

during said foaming step, orienting a substantial number of said elongated fibers so that the major axes of said oriented fibers are essentially uni-directionally disposed within said void space; and after said foaming step, hardening said structural foaming agent with said oriented fibers imbedded in said structural foaming agent.

11. The method according to claim 10 including the additional step of impregnating at least some of said structural element with structural foaming agent during said foaming step.

12. The method according to claim 11 wherein said impregnating step is at least partially accomplished by forcing said structural foaming element into said structural element under pressure during said foaming step.

13. The method of claim 11 including the additional step of consolidating fibers closely adjacent to said structural element during said foaming step.

14. In combination:

a structural element having a void space and a passageway leading from the exterior of said structural element to said void space;

hardened, foamed structural foaming agent substantially filling said void space; and a container in said passageway, said container being at least partially formed of porous material and defining an interior filled with hardened, foamed structural foaming agent, an exterior of said container having hardened foamed structural foaming agent bonded thereto and to the structural element to form a plug in said passageway.

15. The combination of claim 14 wherein discrete fibers are imbedded in the hardened, foamed structural foaming agent within the interior of said container, at least some of said fibers being consolidated and forming a generally mat-like structure immediately adjacent to said porous material.

16. The combination of claim 15 wherein said structural element is a wooden pole.

17. The combination of claim 14 wherein discrete, elongated fibers are imbedded in the hardened, foamed structural foaming agent in the void space, a substantial number of said elongated fibers being oriented so that their major axes are essentially uni-directionally disposed within said void space.

* * * * *